US005374021A

United States Patent [19]

Kleinman

[11] Patent Number: 5,374,021

[45] Date of Patent: Dec. 20, 1994

[54] VACUUM HOLDER PARTICULARY USEFUL AS A VACUUM TABLE

[75] Inventor: Yossie Kleinman, Rehovot, Israel

[73] Assignee: Orbotech Ltd., Yavne, Israel

[21] Appl. No.: 155,717

[22] Filed: Nov. 23, 1993

[30] Foreign Application Priority Data

Nov. 27, 1992 [IL] Israel ..... 103906

[51] Int. Cl.[5] ..... A45D 42/14

[52] U.S. Cl. ..... 248/362; 248/363

[58] Field of Search ..... 248/362, 363; 269/21

[56] References Cited

U.S. PATENT DOCUMENTS

| | | | |
|---|---|---|---|
| 2,910,265 | 10/1959 | Anander | 248/363 |
| 3,126,192 | 3/1964 | Stein | 248/362 |
| 3,146,690 | 9/1964 | Hoffman | 248/363 X |
| 3,307,816 | 3/1967 | Cocito | 248/362 |
| 3,307,817 | 3/1967 | Cocito | 248/362 |
| 3,307,818 | 3/1967 | Cocito | 248/362 |
| 3,307,819 | 3/1967 | Cocito | 248/363 |
| 3,335,994 | 8/1967 | Cocito | 248/363 |
| 5,141,212 | 8/1992 | Beeding | 269/21 |

FOREIGN PATENT DOCUMENTS

| | | | |
|---|---|---|---|
| 0433503 | 6/1991 | European Pat. Off. . | |
| 0456884 | 11/1991 | European Pat. Off. . | |
| 2561221 | 9/1985 | France . | |
| 1926479 | 5/1969 | Germany . | |
| 4000099 | 7/1991 | Germany . | |
| 993408 | 5/1965 | United Kingdom | 248/362 |
| 2058658 | 4/1981 | United Kingdom . | |
| 8304384 | 12/1983 | WIPO . | |

*Primary Examiner*—J. Franklin Foss

*Attorney, Agent, or Firm*—Benjamin J. Barish

[57] ABSTRACT

A vacuum holder for holding articles by suction includes a vacuum chamber divided into a plurality of interconnected sub-chambers each communicating via a control a passageway with a plurality of suction openings extending through an outer holding surface, and a valve member for each control passageway integrally formed with a mounting section mounted to the housing, and an elastic juncture section normally biassing the valve member to open its respective control passageway to permit the application of suction to its plurality of suction openings. Each valve member is displaceable by the suction force applied from its respective vacuum sub-chamber, when its plurality of suction openings are not covered by the article to be held by the holder, to thereby close the control passageway to its respective suction openings.

19 Claims, 3 Drawing Sheets

VACUUM HOLDER PARTICULARY USEFUL AS A VACUUM TABLE

FIELD AND BACKGROUND OF THE INVENTION

The present invention relates to vacuum holders for holding articles by suction. The invention is particularly useful when embodied in a vacuum table for holding various articles, such as printed circuit boards and the like, during inspection or other processing, and the invention is therefore described below particularly with respect to this application.

Vacuum tables are widely used for holding various types of articles during inspection and/or further processing. Such tables include a plurality of suction openings formed in the upper surface of the vacuum table and leading to a suction chamber, such that the suction openings covered by the article placed on the table apply suction to hold the article onto the table. However, it is desirable to construct the vacuum tables of relatively large size so as to accommodate articles of different dimensions. In such cases, some of the suction openings will not be covered by the articles. This results not only in a wastage of suction, but also in a substantial increase in the noise level produced by the flow of air through the suction openings not covered by the article.

The same problem exists not only with respect to vacuum tables, but also with respect to other types of vacuum holders, e.g. conveyor devices for gripping and conveying articles to other locations.

OBJECT AND BRIEF SUMMARY OF THE INVENTION

An object of the present invention is to provide a vacuum holder having advantages in the above respects.

According to the present invention, there is provided a vacuum holder for holding articles by suction, comprising a housing having an internal vacuum chamber connectable to a source of vacuum. The housing includes an outer holding surface contactable by the article to be held, and formed with a suction opening leading via a control passageway to the vacuum chamber. The housing also includes a valve member displaceable to open the control passageway to thereby apply suction from the vacuum chamber to the suction opening, or to close the control passageway to thereby block the application of suction from the vacuum chamber to the suction opening. The suction opening in the housing normally is exposed to the atmosphere, but is coverable by an article when in contact with the holding surface of the housing. The valve member is integrally formed with a mounting section and an elastic juncture section which normally biasses the valve member to open the control passageway to permit the application of suction to the suction opening, the valve member being displaceable to close the control passageway, by the suction force applied from the vacuum chamber, when the suction opening is not covered by an article to be held by the holder.

According to further features in the described preferred embodiment, the control passageway is in a partition member located between the vacuum chamber and the suction opening, the valve member being a part of an elastic sheet between the partition member and the holding surface of the housing and normally of a planar configuration biassed to close the control passageway in the partition member.

According to another aspect of the present invention, there is provided a vacuum holder for holding articles by suction, comprising a housing having an outer holding surface contactable by the article to be held and formed with a vacuum chamber connectible to a source of vacuum. The vacuum chamber is divided into a plurality of interconnected sub-chambers each communicating via a control passageway with a plurality of suction openings extending through the outer holding surface. The housing further includes a valve member for each control passageway. Each valve member is integrally formed with a mounting section mounted to the housing, and an elastic juncture section normally biassing the valve member to open its respective control passageway to permit the application of suction to its plurality of suction openings. Each valve member is displaceable by the suction force applied from its respective vacuum sub-chamber when its plurality of suction openings are not covered by the article to be held by the holder, to thereby close the control passageway to its respective suction openings.

The invention is particularly useful when embodied in a vacuum table, wherein the housing is in the form of a table in which the outer holding surface thereof is in an upper panel formed with the suction openings and adapted to receive and hold articles placed thereon. When embodied in a vacuum table, preferably the vacuum chamber is divided into a plurality of interconnecting sub-chambers each covered by a partition member formed with a control passageway. The vacuum table preferably further includes spacer means for spacing the partition members from the inner surface of the upper housing panel to define therewith a plurality of outlet chambers each in communication with one of the vacuum sub-chambers and a plurality of suction openings via one of the control passageways.

The invention is described below, for purposes of example, with respect to two preferred embodiments, both in the form of a vacuum table. In one described embodiment, the housing includes a rigid base member formed with a plurality of upwardly-facing, interconnecting cavities defining the interconnecting sub-chambers, the upper panel formed with the suction openings being secured over the rigid base member. In a second described embodiment, the upper panel is an integral part of the base member; the base member is formed with a plurality of downwardly-facing, interconnected cavities defining the interconnecting vacuum sub-chambers, and the housing further includes an imperforate lower panel closing the interconnecting vacuum sub-chambers.

As will be described more particularly below, a vacuum holder, and particularly a vacuum table, constructed in accordance with the foregoing features, establishes a vacuum only with respect to the suction openings covered by the article, and blocks the vacuum from the suction openings not covered by the article. Such a vacuum holder or vacuum table thus substantially reduces the amount of suction required, and also reduces the amount of noise produced during the operation of the device, when the device is constructed of relatively large size so as to accommodate different-sized articles.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
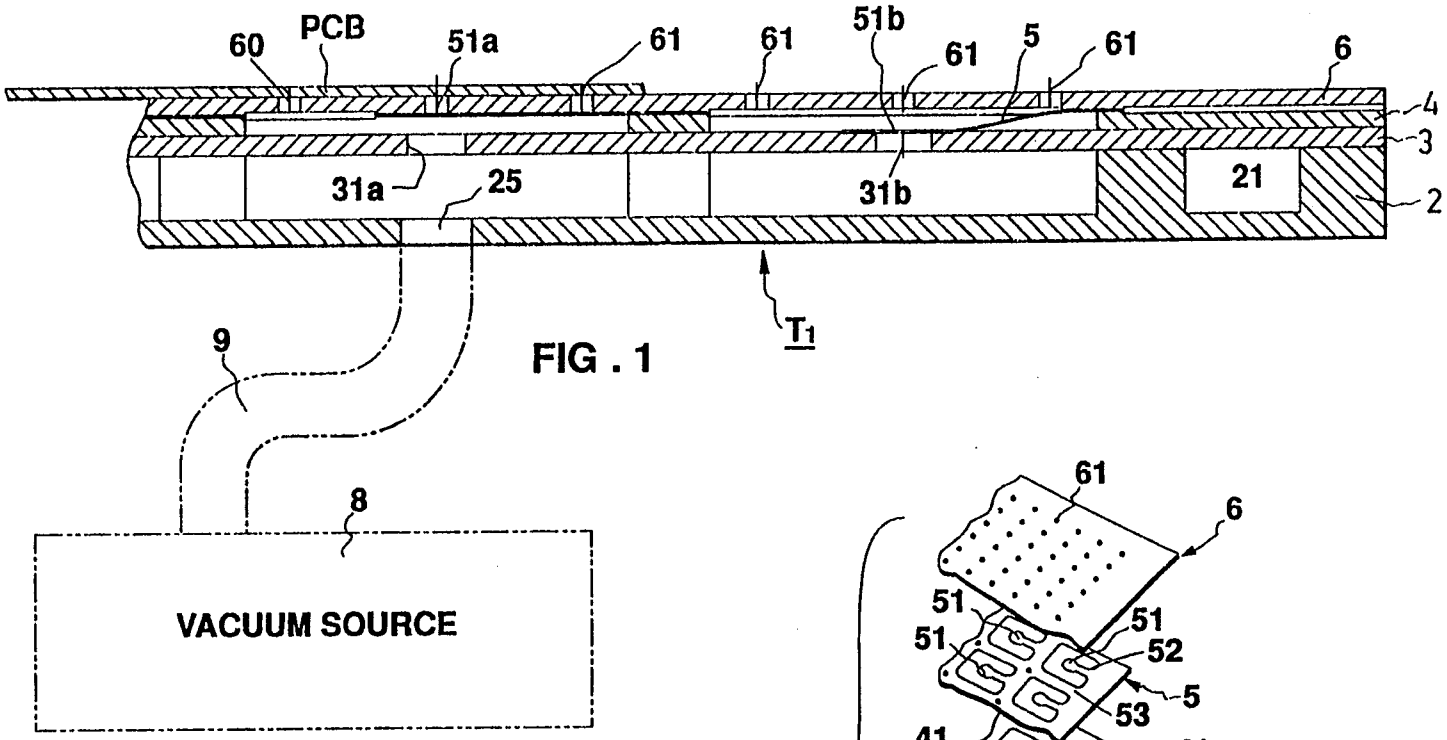
FIG. 1 is a longitudinal sectional view illustrating one form of vacuum table constructed in accordance with the present invention.
Figure 2:
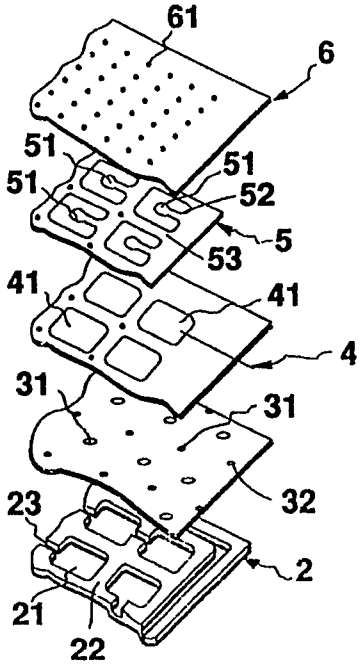
FIG. 2 is a fragmentary, exploded view illustrating the main elements of the vacuum table of FIG. 1.

The Embodiment of FIGS. 1 and 2

The vacuum table illustrated in FIGS. 1 and 2 is particularly useful for receiving and holding articles, such as a printed circuit board (PCB) for inspection and/or processing. The vacuum table is constructed of sufficiently large size so as to accommodate all sizes of printed circuit boards. Therefore, in most cases, many of the suction openings formed in the vacuum table will not be covered by the printed circuit board thereon. The illustrated vacuum table is thus constructed so that suction will be applied only to the openings covered by the printed circuit board PCB, and no suction, or substantially no suction, will be applied to the openings not covered by the printed circuit board PCB, thereby reducing wastage of suction, and probably more important, reducing the noise produced by the free flow of air through uncovered suction openings.

The vacuum table illustrated in FIGS. 1 and 2, and therein designated $T_1$, is constructed of the following main elements: a rigid base member 2; a partition member 3 thereover; a spacer member 4 thereover; a sheet 5 thereover defining a plurality of valve members; and an upper panel 6 formed with a plurality of suction openings (61) and adapted to receive and hold the printed circuit board PCB thereon. The foregoing elements will be described more particularly below. The vacuum table $T_1$ is adapted to be connected to a vacuum source 8 via a vacuum tube 9.

The rigid base member 2 is formed with a plurality of upwardly-facing cavities 21. Each cavity is circumscribed by a wall 22 formed with a slot 23 such that the cavities 21 are interconnecting. Base member 2 is further formed with an opening 25 connected by vacuum tube 9 to the vacuum source 8. The upper side of the cavities 21 is closed by the partition member 3 such that the latter member defines, with the cavities 21 of base member 2, a plurality of vacuum sub-chambers interconnected by slots 23.

The partition member 3 is in the form of a sheet, e.g. of aluminum or plastic. It is formed with a plurality of openings 31, one for each of the vacuum sub-chambers 21. The partition sheet 3 may be further formed with a plurality of smaller openings 32, to assist in adhesively bonding the partition member to the rigid base 2 and also to the overlying spacer member 4.

Spacer member 4 is also in the form of a sheet. It has a plurality of cut-outs 41 of the same configuration as, and aligned with, one of the vacuum sub-chamber cavities 21 formed in the rigid base member 2. It will thus be seen that the control passageway openings 31 formed in the partition member 3 are each located centrally of one of the vacuum sub-chamber cavities 21 in the rigid base member 2 on one side, and centrally of one of the cut-outs 41 in the spacer sheet 4 on the opposite side.

The valve member sheet 5 overlying the spacer member 4 may be (Dr metal, e.g. stainless steel, or plastic. It is formed with a plurality of valve members 51 for, and aligned with, each of the control passageway openings 31 formed in the partition member 3. Each of the valve members by valve member 51*a*, 51*b* 51 is of planar configuration, as illustrated particularly in FIG. 1, and is integrally formed with an elastic juncture section 52, and a common outer frame 53, which serves as a mounting section for all the valve members.

The upper panel 6 included in the vacuum table is formed with the plurality of suction openings 61 through which suction is applied for holding the article PCB on the table. The suction openings 61 are smaller in diameter, and larger in number, than the connecting passageways 31 formed in the partition member 3, and are preferably arranged according to a rectangular matrix as illustrated in FIG. 2. For example, a 3-by-3 matrix of suction openings 61 may be provided and aligned with each of the cut-outs 41 in the spacer sheet 4 such that each of the cut-outs defines a common outlet chamber for nine of the suction openings 61.

The vacuum table illustrated in FIGS. 1 and 2 operates as follows:

The valve members 51, in their normal unstressed condition, are substantially coplanar with their common frame 53; that is, their juncture sections 52 are not bent. Thus, the valve members 51 are normally biassed to the position illustrated by valve member 51*a* in FIG. 1, opening its respective connecting passageway 31*a*.

Now, when the vacuum source 8 is applied via tube 9 to the interconnecting sub-chambers defined by the cavities 21 in the base member 2, the vacuum will apply a force displacing the valve members 51 towards their respective connecting passageways 31 to close those passageways, as illustrated by valve member 51*b* closing passageway 31*b* in FIG. 1. This displacement of the valve members 51 will occur only with respect to all the connecting passageways communicating with suction openings 61 not covered by the article PCB on the table.

Thus, with respect to those suction openings 61 not covered by the printed circuit board PCB, the upper face of the valve member 51 will be exposed to the atmosphere, whereas the lower face will be exposed to the vacuum within the respective sub-chamber cavity 21, so that the valve member will be drawn against the upper surface of the partition member 3 to close the respective connecting passageway 31, as shown by valve member 51*b* closing its connecting passageway 31*b* in FIG. 1. Accordingly, no vacuum will be applied to the suction openings 61 communicating with connecting passageways 31 via the outlet chambers 41 formed in the spacer member However, with respect to the suction openings 61 covered by the printed circuit board PCB, atmospheric pressure will not be applied to the upper surface of the respective valve member 51; thus, the pressure on both sides of the valve member will be the same, so that the valve member will move to its normal position opening its respective connecting passageway, as shown by valve member 51*a*, opening connecting passageway 31*a* in FIG. 1. Accordingly, the vacuum from the respective sub-chamber cavity 21 will be applied via connecting passageway 31 to the suction openings 61 communicating with that connecting passageway via the outlet chamber defined by the cut-out 41 in spacer member 4, thereby firmly holding the printed circuit board PCB to the table.

It will thus be seen that the table illustrated in FIGS. 1 and 2 automatically applies vacuum only to those suction openings 61 which are actually covered by the printed circuit board PCB, and does not apply suction to those openings not covered by the printed circuit board PCB. Accordingly, the illustrated construction enables the vacuum table to be made of a relatively large size to accommodate different-size articles, without wastage of suction when used with smaller-size articles, and without producing undue noise by the air flow through suction openings not covered by the article.

Figure 3:
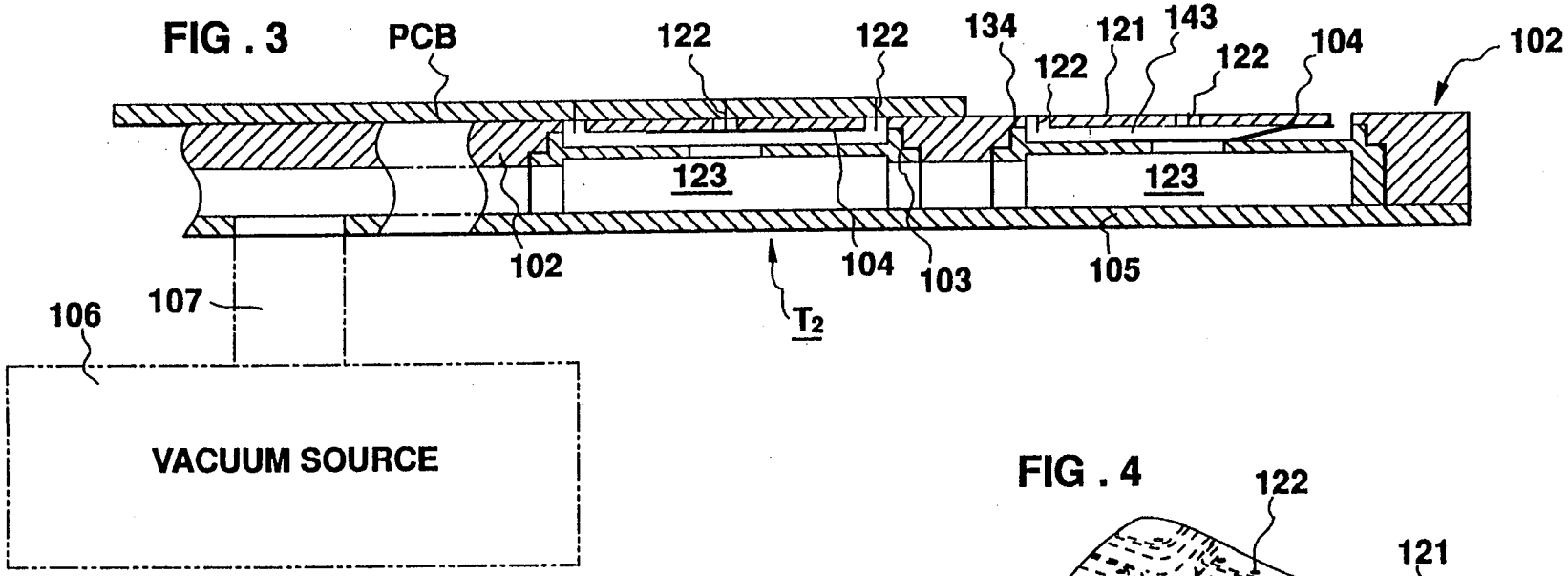
FIG. 3 is a longitudinal sectional view illustrating a second form of vacuum table constructed in accordance with the present invention.
Figure 4:
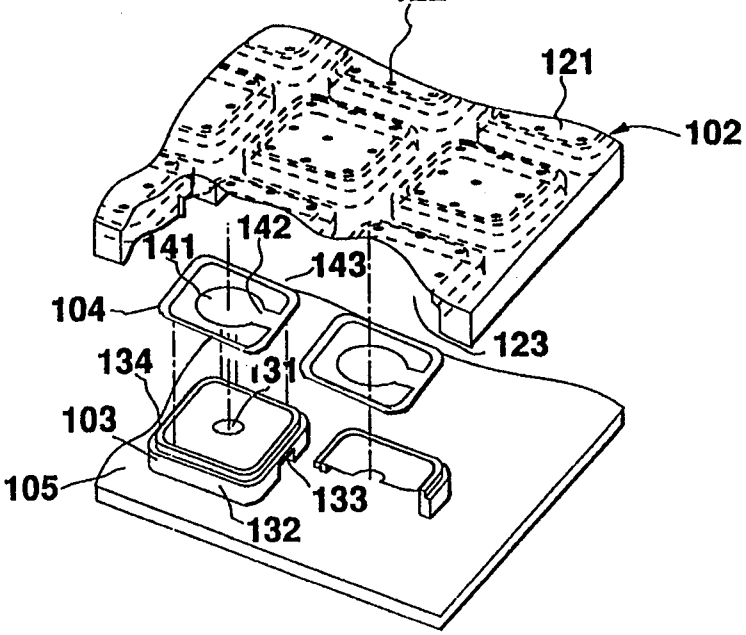
FIG. 4 is a fragmentary, exploded view illustrating the main elements of the vacuum table of FIG. 3 when viewed from above.
Figure 5:
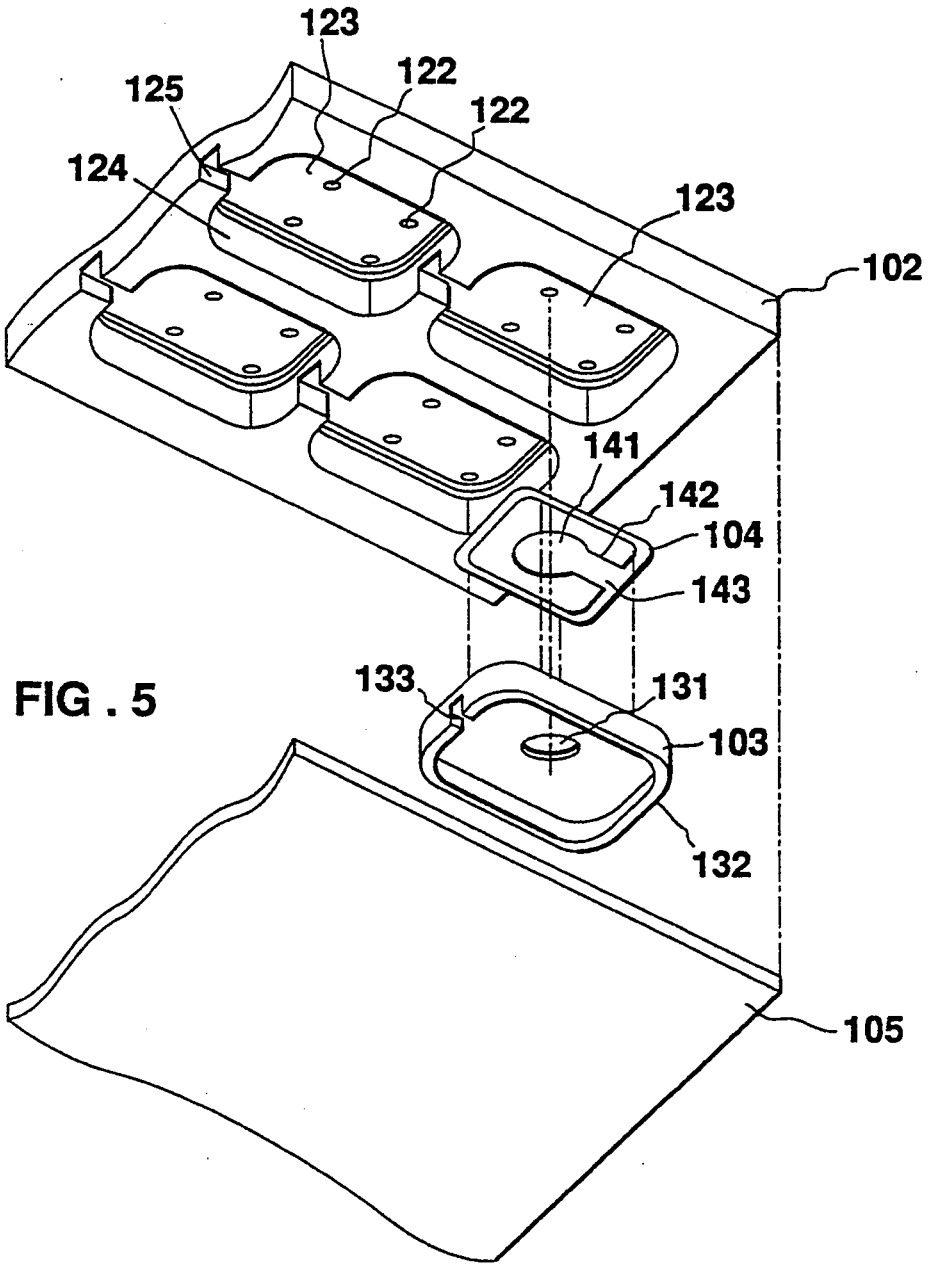
FIG. 5 is a similar view as FIG. 4 but when viewed from below.

The Embodiment of FIGS. 3–5

FIGS. 3–5 illustrate a second vacuum table, therein designated $T_2$, constructed in accordance with the present invention. In this construction, the vacuum table includes a rigid base member 102, a plurality of partition members 103, a plurality of valve members 104, and an imperforate cover panel 105. Suction is applied to the table by a vacuum source 106 via a vacuum tube 107.

In the table illustrated in FIGS. 3–5, the base member 102 is integrally formed with the upper panel 121 having the plurality of suction openings 122 for holding the article, e.g. a printed circuit board PCB, on the vacuum table. The base member 102 is further formed with a plurality of downwardly-facing cavities 123 circumscribed by walls 124 formed with slots 125 defining, with the cover plate 105, a plurality of interconnected vacuum sub-chambers.

A partition member 103 is provided for each of the cavities 123. Each partition member 103 is of the same size and configuration as its respective cavity 123 and is formed with a central opening 131. Openings 131 serve as connecting passageways corresponding to connecting passageways 31 in the embodiment of FIGS. 1 and 2. In the embodiment of FIGS. 3–5, however, the partition members 103 are in the form of separate members, one for each of the cavities 123, rather than in the form of a common sheet, as sheet 3 in FIGS. 1 and 2. Each partition member 103 also includes four side walls 132 enabling the partition members to be press-fitted into the cavities 123 of the base member 102. Walls 132 of the partition members 103 are formed with slots 133 corresponding to slots 125 in the base member 102 to interconnect the cavities 123 of the base member.

The vacuum table of FIGS. 3–5 also includes a separate valve device 104 for each of the vacuum sub-chambers 123. The valve device 104 is also made of elastic metal or plastic and is integrally formed with a valve member 141 joined by an elastic juncture section 142 to an outer mounting section 143. Valve device 104 is inserted into the respective vacuum sub-chamber 123 between its partition member 103 and the under surface of the top panel 121 of the rigid base member 102, with the valve member 141 in alignment with the connecting passageway 131.

The face of each partition member 103 receiving the valve device 104 is formed with a peripheral rib 134 circumscribing the outer border 143 of its respective valve member 141. Rib 134 thus serves as spacing means, corresponding to spacer sheet 4 in FIGS. 1 and 2, which defines a plurality of outlet chambers 144 (FIG. 3) communicating on one side with the respective connecting passageway 131, and on the opposite side with the respective group of suction openings 122 formed in the top panel 121 of the base member 102.

It will be seen that the vacuum table illustrated in FIGS. 3–5 operates in substantially the same manner as described above with respect to FIGS. 1 and 2. Thus, the valve members 141 are normally planar with respect to their frames 143 so that they are normally biassed to open their respective connecting passageways 131 in the partition member 103. When vacuum is applied, the suction openings 122 not covered by the printed circuit board PCB on the table will expose the upper surfaces of the respective valve members 141 to atmospheric pressure, so that the suction applied to the lower surfaces will displace the valve members 141 to close their respective connecting passageways 131, thereby blocking suction to those suction openings 122; however, the suction openings 122 covered by the printed circuit board PCB block the application of atmospheric pressure to the upper surfaces of the respective valve members 141, such that the valve members assume their normal bias position to open their respective connecting passageways 131, and thereby apply the suction to the printed circuit board PCB covering the suction openings 122.

While the invention has been described with respect to two preferred embodiments, it will be appreciated that these are set forth purely for purposes of example, and that many other variations, modifications and applications of the invention may be made.

What is claimed is:

1. A vacuum holder for holding articles by suction, comprising:

a housing having an internal vacuum chamber connectable to a source of vacuum;

said housing including an outer holding surface contactable by the article to be held, and formed with a suction opening leading via a control passageway to said vacuum chamber;

and a valve member within said housing and displaceable to open said control passageway to thereby apply suction from said vacuum chamber to said suction opening, or to close said control passageway to thereby block the application of suction from said vacuum chamber to said suction opening;

said suction opening in said housing normally being exposed to the atmosphere, but being covered by an article when in contact with said holding surface of the housing;

said valve member being integrally formed with a mounting section mounted to the housing, and an elastic juncture section which normally biasses the valve member to open said control passageway to permit the application of suction to said suction opening, the valve member being displaceable to close said control passageway, by the suction force applied from said vacuum chamber when the suction opening is not covered by an article to be held by the holder;

said control passageway being in a partition member located between said vacuum chamber and said suction opening;

said valve member being a part of an elastic sheet located between said partition member and said holding surface of the housing and normally of a planar configuration opening said control passageway in the partition member.

2. The vacuum holder according to claim 1, wherein said holding surface of the housing is formed with a plurality of suction openings communicating with said vacuum chamber via a plurality of said control passageways, there being one of said valve members for each of said control passageways effective to apply suction to the suction openings covered by an article to be held, but to block suction with respect to the suction openings not covered by an article to be held.

3. The vacuum holder according to claim 2, wherein said housing is in the form of a table in which said outer holding surface thereof is in an upper panel formed with said suction openings and adapted to receive and hold articles placed thereon.

4. The vacuum holder according to claim 3, wherein said vacuum chamber is divided into a plurality of interconnecting sub-chambers each covered by a said partition member formed with a control passageway.

5. The vacuum holder according to claim 4, further including spacer means for spacing said partition member from the inner surface of said upper housing panel to define therewith a plurality of outlet chambers each in communication between one of said vacuum sub-chambers and a plurality of suction openings via one of said control passageways.

6. The vacuum holder according to claim 5, wherein said housing includes a rigid base member formed with a plurality of upwardly-facing, interconnecting cavities defining said interconnecting sub-chambers, said upper panel formed with said suction openings being secured over said rigid base member.

7. The vacuum holder according to claim 6, wherein said partition member is a sheet between said rigid base member and said upper panel, and is formed with said plurality of control passageways.

8. The vacuum holder according to claim 7, wherein said spacer means includes a sheet between said partition sheet and said upper panel, and formed with a plurality of cut-outs, one for and aligned with each of said control passageways.

9. The vacuum holder according to claim 8, wherein said plurality of valve members are integrally formed in a common sheet of elastic material located between said spacer sheet and said upper panel, and with one of said valve members for and in alignment with each of said control passageways.

10. The vacuum holder according to claim 5, wherein said upper panel is an integral part of the base member, said base member being further formed with a plurality of downwardly-facing, interconnected cavities defining said interconnecting vacuum sub-chambers, said housing further including an imperforate cover panel closing said interconnecting vacuum sub-chambers.

11. The vacuum holder according to claim 10, wherein there is a separate partition member for and secured within each of said cavities of the base member, and formed with one of said control passageways.

12. The vacuum holder according to claim 11, wherein there is a separate valve member for each of said partition members and secured by the respective partition member in its cavity of the base member in alignment with its control passageway.

13. The vacuum holder according to claim 12, wherein each partition member is formed with a peripheral rib circumscribing its respective valve member, the ribs of all the partition members serving as said spacer means defining said plurality of outlet chambers each establishing communication between one of said vacuum sub-chambers and a plurality of suction openings via one of said control passageways.

14. A vacuum holder for holding articles by suction, comprising:

a housing having an outer holding surface contactable by the article to be held;

said housing being formed with a vacuum chamber connectible to a source of vacuum;

said vacuum chamber being divided into a plurality of interconnected sub-chambers each communicating via a control passageway with a plurality of suction openings extending through said outer holding surface;

and a plurality of valve members, one for each of said control passageways;

each of said valve members integrally formed with a mounting section mounted to the housing, and an elastic juncture section normally biassing the valve member to open its respective control passageway to permit the application of suction to its plurality of suction openings, each valve member being displaceable by the suction force applied from its respective vacuum sub-chamber when its plurality of suction openings are not covered by the article to be held by the holder, to thereby close said control passageway to its respective suction openings;

each of said control passageways being in a partition member located between said vacuum chamber and a said suction opening;

each of said valve members being a part of an elastic sheet located between said partition member and said holding surface of the housing and normally of a planar configuration opening the control passageway in the partition member.

15. The vacuum holder according to claim 14, wherein all said valve members are integrally formed in a common sheet of elastic material.

16. The vacuum holder according to claim 15, wherein said control passageways are formed in a partition sheet located between said interconnected sub-chambers and said valve member sheet.

17. The vacuum holder according to claim 16, further including a spacer sheet located between said outer holding surface and said valve member sheet and formed with a plurality of cut-outs, one for and aligned with each of said control passageways.

18. The vacuum holder according to claim 14, wherein each of said control passageways is formed in a separate partition member in each of said interconnected sub-chambers.

19. The vacuum holder according to claim 18, wherein each of said valve members is carried by a separate sheet of elastic material mounted to one of the partition members to overlie its respective control passageway.

* * * * *